US010876530B2

(12) United States Patent
Ait Bouziad et al.

(10) Patent No.: US 10,876,530 B2
(45) Date of Patent: Dec. 29, 2020

(54) ROTARY COMPRESSOR ARRANGEMENT

(71) Applicant: Nestec S.A., Vevey (CH)

(72) Inventors: Youcef Ait Bouziad, Echandens (CH); Nicolas Ganshof Van Der Meersch, Vufflens-le-Château (CH)

(73) Assignee: Societe des Produits Nestle S.A., Vevey (CH)

( * ) Notice: Subject to any disclaimer, the term of this patent is extended or adjusted under 35 U.S.C. 154(b) by 42 days.

(21) Appl. No.: 16/309,198

(22) PCT Filed: Jul. 3, 2017

(86) PCT No.: PCT/EP2017/066475

§ 371 (c)(1),
(2) Date: Dec. 12, 2018

(87) PCT Pub. No.: WO2018/007306

PCT Pub. Date: Jan. 11, 2018

(65) Prior Publication Data

US 2019/0309752 A1 Oct. 10, 2019

(30) Foreign Application Priority Data

Jul. 8, 2016 (EP) ..... 16178581

(51) Int. Cl.

| | |
|---|---|
| ***F04C 29/00*** | (2006.01) |
| ***F04C 27/00*** | (2006.01) |
| ***F04C 18/344*** | (2006.01) |
| ***F04C 29/02*** | (2006.01) |
| ***F01C 1/10*** | (2006.01) |

(52) U.S. Cl.
CPC ..... *F04C 29/0057* (2013.01); *F04C 18/3441* (2013.01); *F04C 29/02* (2013.01)

(58) Field of Classification Search
CPC ..... F04C 27/001; F04C 29/0057; F04C 18/3441; F04C 29/02; F01C 1/104
See application file for complete search history.

(56) References Cited

U.S. PATENT DOCUMENTS 3,346,176 A * 10/1967 Eugene ..... F01C 21/106 418/137
3,426,735 A * 2/1969 Kelly ..... F01C 1/3442 123/243
3,865,515 A * 2/1975 Allen ..... F01C 21/10 417/283

(Continued)

FOREIGN PATENT DOCUMENTS

WO 2016156280 A1 10/2016

OTHER PUBLICATIONS

International Search Report, dated Oct. 18, 2017, in PCT/EP2017/066475, filed Jul. 3, 2017.

(Continued)

*Primary Examiner* — Deming Wan
(74) *Attorney, Agent, or Firm* — K&L Gates LLP

(57) ABSTRACT

A rotary compressor arrangement is disclosed that includes a body centered at a shaft axis, a cylindrical piston arranged with respect to the body such that an inner volume is created between them, and guiding means arranged at an offset axis with respect to the shaft axis. Also disclosed is a cooling/refrigerant system that includes the rotary compressor arrangement.

19 Claims, 21 Drawing Sheets

(56) References Cited

U.S. PATENT DOCUMENTS

| | | | | |
|---|---|---|---|---|
| 5,399,076 | A | 3/1995 | Matsuda et al. | |
| 5,472,327 | A | 12/1995 | Strikis et al. | |
| 5,782,623 | A * | 7/1998 | Brox | F04C 5/00 418/153 |
| 8,607,762 | B2 | 12/2013 | Wooldridge et al. | |

OTHER PUBLICATIONS

Written Opinion of the International Searching Authority, dated Oct. 18, 2017, in PCT/EP2017/066475, filed Jul. 3, 2017.

* cited by examiner

ROTARY COMPRESSOR ARRANGEMENT

CROSS-REFERENCE TO RELATED APPLICATIONS/INCORPORATION BY REFERENCE STATEMENT

This application is a US national stage application filed under 35 USC § 371 of International Application No. PCT/EP2017/066475, filed Jul. 3, 2017; which claims priority to EP App No. 16178581.1, filed Jul. 8, 2016. The entire contents of the above-referenced patent applications are hereby expressly incorporated herein by reference.

TECHNICAL FIELD

The present disclosure is directed to a rotary compressor arrangement and, more specifically, to a rotary compressor arrangement of the vane type such as (but not limited to) that used in a cooling or refrigerating system.

BACKGROUND

Currently, different types of compressors are used in cooling or refrigeration systems. For home applications, vane rotary compressors are commonly used thanks to their reduced size.

Typically, a vane rotary compressor comprises a circular rotor rotating inside of a larger circular cavity configured by the inner walls of the compressor housing. The centers of the rotor and of the cavity are offset, causing eccentricity. Vanes are arranged in the rotor and typically slide into and out of the rotor and are tensioned to seal on the inner walls of the cavity, in order to create vane chambers where the working fluid, typically a refrigerant gas, is compressed. During the suction part of the cycle, the refrigerant gas enters through an inlet port into a compression chamber where the volume is decreased by the eccentric motion of the rotor and the compressed fluid is then discharged through an outlet port.

While small sized vane rotary compressors are advantageous, leaking of refrigerant through the surfaces of the inner walls of the compressor housing is disadvantageous. This is why these compressors also use lubricating oil, having two main functions: one is to lubricate the moving parts, and the second one is to seal the clearances between the moving parts, which minimizes gas leakage that can adversely affect the efficiency of the compressor.

Known in the state of the art are small sized compressors of the rotary vane type such as the one described in EP 1831561 B1, where the losses of the refrigerant are countered by making very specific design and maintaining the dimensions of the parts of the compressor under extremely tight tolerances in order to still provide a good compressor performance while maintaining a miniature scale. The result is that small deviations in these tolerances would largely affect the efficiency of the compressor and, at the same time, the compressor so designed is very complex to manufacture and is very costly.

Document KR 101159455 discloses a rotary vane compressor where a shaft joined to a rotor rotates guided by a plurality of ball bearings: the problem of such a configuration is that these bearings respond as hard points allowing no flexibility in this rotation, thus preventing any adjustment or absorption of shocks by the system, which can be thus easily damaged in certain cases.

Patent Application EP 15161944.2 was filed by the same applicant disclosing a rotary compressor arrangement comprising a guiding element (satellite element) orbiting around a shaft axis and entraining in rotation around this shaft axis a cylindrical piston over a body of the compressor. This arrangement works with one guiding element (satellite) and ensuring one contact point between the body and the cylindrical piston. Moreover, there is one guiding point in this arrangement, which is that of the satellite element with respect to the external walls of the cylindrical piston, a certain pressure or force being maintained between the satellite element and the cylindrical piston to keep such guiding point. In this arrangement, the force exerted by the pressure in the inner compressor chamber is taken by the satellite in a single contact point, leading to considerable efforts.

In order to overcome the problems existing in the state of the art, and further to optimize the distribution of efforts coming from the compression, the present disclosure is presented. Furthermore, the present disclosure also aims at other objects and particularly the solution of other problems as it will appear in the rest of the present description.

BRIEF DESCRIPTION OF THE DRAWINGS

Further features, advantages and objects of the present disclosure will become apparent for a skilled person when reading the following detailed description of embodiments of the present disclosure, when taken in conjunction with the figures of the enclosed drawings.

DETAILED DESCRIPTION

Figure 1:
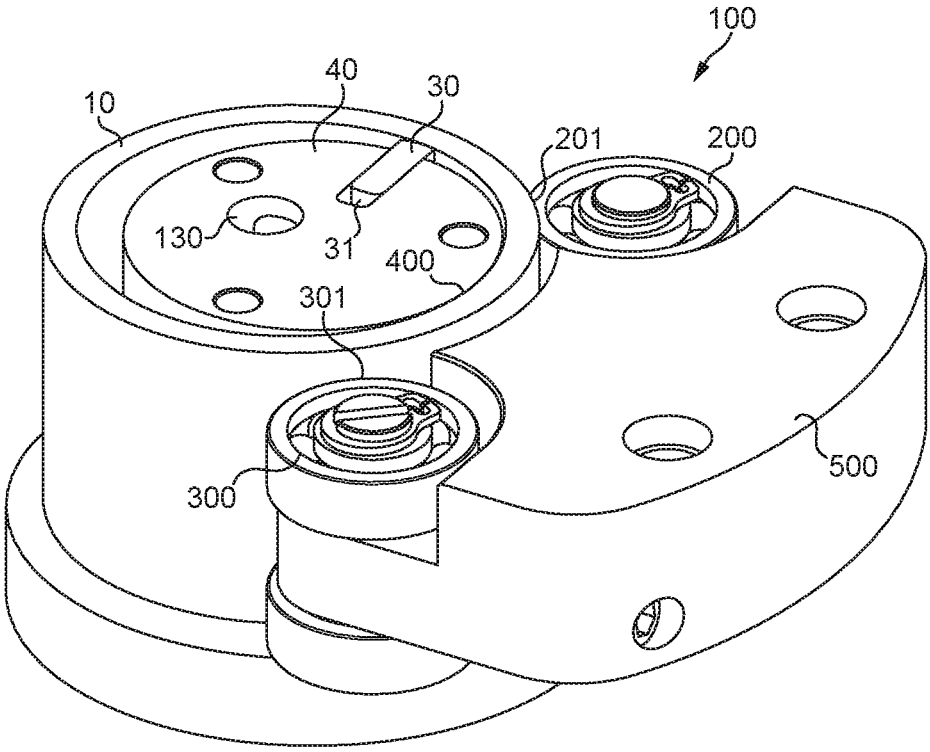
FIG. 1 shows an overview of the rotary compressor arrangement according to a first embodiment of the present disclosure.

According to a first aspect, the present disclosure relates to a rotary compressor arrangement comprising a body centered at a shaft axis and a cylindrical piston eccentrically arranged with respect to the body such that an inner volume is created between them, into which volume a compressible fluid can be introduced. The arrangement further comprises guiding means arranged at an offset axis with respect to the shaft axis, the guiding means rotating around the shaft axis, entraining and guiding in rotation the cylindrical piston over the body. The guiding means provide at least two guiding points when contacting the external surface of the cylindrical piston, such that the guiding points are positioned in such a way with respect to the cylindrical piston that a contact point between the body and the cylindrical piston, within the inner volume, is ensured during the rotation of the cylindrical piston.

In certain non-limiting embodiments, the guiding means are arranged such that the guiding points created are angularly located on each side of the contact point, at least one of the guiding points being located on the side of the resulting force generated by the fluid in the inner volume on the cylindrical piston.

Typically, according to the present disclosure, at least one of the guiding points is located close to the point of the maximum resulting force generated by the fluid in the inner volume on the cylindrical piston.

In certain non-limiting embodiments, the guiding means are arranged at a maximum angle of 180°.

According to a possible embodiment of the present disclosure, the guiding points are arranged on a same radius, with respect to the shaft axis, at substantially equal angles with respect to the contact point. In a different embodiment, the guiding points are arranged on two different radiuses, with respect to the shaft axis.

In a first embodiment of the present disclosure, the guiding means comprise two satellite guiding means, each one contacting the cylindrical piston in a guiding point, the guiding means rolling and/or sliding over the cylindrical piston while orbiting around the shaft axis. Typically, the guiding means are mounted on supporting orbiting means rotating around the shaft axis.

In a second embodiment of the present disclosure, the guiding means are mounted onto a pivotable support, rotating around the shaft axis and which is further able to pivot over a pivoting point.

Still in a third embodiment of the present disclosure, the guiding means comprise a slider, covering a full angular arc in the external wall of the cylindrical piston creating a plurality of guiding points. In certain non-limiting embodiments, the slider is made in steel or in a material having appropriate tribologic properties, such as PTFE, polymer, graphite, or the like, for minimum friction.

Typically, according to the present disclosure, the rotary compressor arrangement further comprises at least one vane slidable within the body during rotation of the cylindrical piston in such a way that it contacts the inner wall of the cylindrical piston. In certain non-limiting embodiments, it further comprises a tensioning device exerting pressure over the at least one vane so that it contacts the inner wall of the cylindrical piston as it rotates around the body.

According to the present disclosure, the at least one vane typically creates at least one compression chamber whose volume is decreased by rotation of the cylindrical piston so that a compressible fluid is compressed before being discharged.

In certain non-limiting embodiments, the rotary compressor arrangement of the present disclosure comprises an entry for the refrigerant fluid being admitted into the inner volume and an outlet for the compressed refrigerant fluid exiting the inner volume, the inlet and the outlet (140) being each arranged on one side of the vane.

The rotary compressor arrangement of the present disclosure typically further comprises a motor driving the guiding means to orbit around the shaft axis.

In certain non-limiting embodiments, the compressible fluid comprises a refrigerant gas.

According to the present disclosure, lubricating oil can also be provided together with the compressible fluid, the lubricating oil being compatible with the compressible fluid.

Typically, the rotary compressor arrangement of the present disclosure further comprises an upper plate and a lower plate arranged to close in height in a tight manner at least one compression chamber created between the body and the cylindrical piston. In certain non-limiting embodiments, it further comprises at least one segment element arranged between the upper and/or lower plates to allow a tight sealing of at least one compression chamber and the movement of the cylindrical piston. Typically, the at least one segment element comprises a low friction material.

According to a second aspect, the present disclosure relates to a cooling/refrigerating system comprising a rotary compressor arrangement as the one described.

The present disclosure relates to a vane rotary compressor arrangement, called in what follows rotary compressor arrangement 100 or simply rotary compressor 100. In certain non-limiting embodiments, the rotary compressor 100 of the present disclosure is used in cooling or refrigerating systems, and the working fluid is typically any compressible gas, such as (but not limited to) a refrigerant gas or a mixture comprising a refrigerant gas.

The rotary compressor 100 comprises an inlet 130 through which the working fluid enters the compressor and an outlet 140 through which this fluid, once compressed, exits the mentioned compressor.

Figure 13:
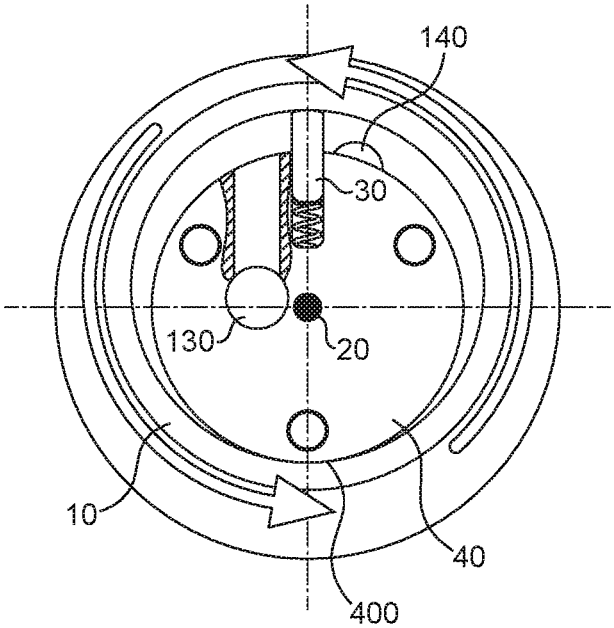
FIG. 13 shows an exemplary overview of the cylindrical piston and the body in a position such that the contact point is arranged at an angular position of 180°.
Figure 14:
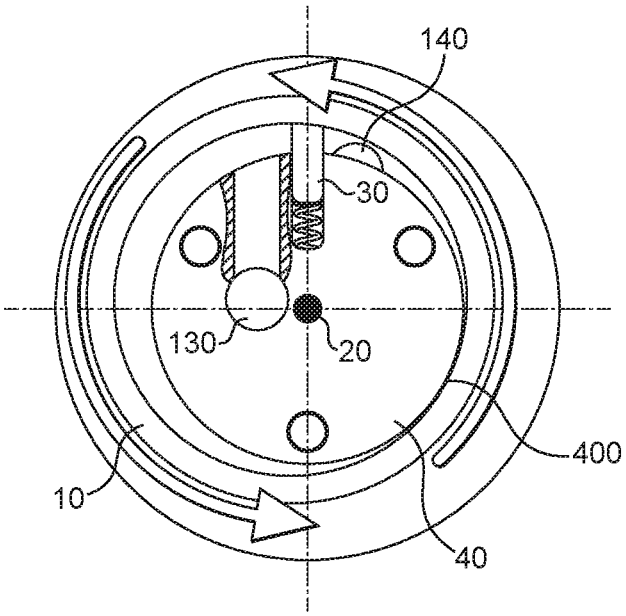
FIG. 14 shows an exemplary overview of the cylindrical piston and the body similar to that of FIG. 13 but in a position such that the contact point is arranged at an angular position of around 225°.

The compressor of the present disclosure further comprises a cylindrical piston 10 inside of which a body 40 is arranged centered by an axis shaft X. The compressor also comprises a vane 30 which can slide into a slot 31 in order to contact the internal walls of the cylindrical piston 10 and create a tight compression chamber where fluid will be compressed, as it will be further explained in more detail. The body 40 is arranged eccentrically inside the cylindrical piston 10. FIGS. 13 and 14 show the fluid inlet 130 and the fluid outlet 140 in a compressor arrangement 100 according to the present disclosure: the inlet 130 and the outlet 140 for the working fluid are arranged in the body 40, and in certain non-limiting embodiments, are arranged in the vicinity of the vane 30.

The arrangement of the present disclosure is made in such a way that the shaft 20 and the body 40 are one single piece within the rotary compressor 100 and are static: the shaft 20 is arranged at the centre of the body 40. However, it is the cylindrical piston 10 which rotates around the body 40 (in fact, around the body 40 together with the shaft 20).

According to the present disclosure, the arrangement 100 comprises as per one embodiment (see for example FIG. 1 or 6) first guiding means 200 and second guiding means 300, such that the cylindrical piston 10 is entrained in rotation by means of these first and second guiding means 200, 300, as it will be further explained in more detail.

The vane 30 is slidable within the slot 31 arranged in the body 40: pressure is maintained in this slot 31 to make the vane 30 contact the inner wall of the cylindrical piston 10 during the whole rotation of the cylindrical piston 10 with respect to the body 40. For this to happen the arrangement of the present disclosure comprises a tensioning device 32 inside the slot 31 exerting pressure over the vane 30 so that it contacts the inner wall of the cylindrical piston 10: any kind of tensioning device 32 providing such functionality can be used in the arrangement of the present disclosure, typically a spring, though a pneumatic device is also possible. The vane 30 can divide the inner volume between the body 40 and the cylindrical piston 10 in fluid chambers.

The referential system in the rotary compressor 100 of the present disclosure is actually inverted with respect to standard solutions in the prior art: the body 40 is fixed and the cylindrical piston 10 is the part rotating around the fixed body 40.

The Figures in the present patent application show one embodiment of the present disclosure with only one vane 30: however, it is also possible according to the present disclosure and comprised within the scope of it, that the rotary compressor arrangement comprises more than one vane 30, so more than one compression chamber 110 is formed between the body 40 and the cylindrical piston 10. In this case, there would be more than one fluid outlet 140 through which the compressed fluid would be dispensed after having been compressed (compression occurring in several steps).

FIG. 1 shows a first embodiment of the compressor arrangement of the present disclosure, provided with first guiding means 200 and second guiding means 300. Both first and second guiding means 200, 300 contact the external wall of the cylindrical piston 10 in respectively first and second guiding points 201, 301, which therefore ensure the existence of a contact point 400 between the cylindrical piston 10 and the body 40. During the whole movement and functioning of the compressor arrangement, it is ensured that there are two guiding points externally to the cylindrical piston 10 and that there is a contact point 400 continuously maintained during the movement of the piston 10 over the body 40 in order to provide a correct tightness in the inner chamber between the body 40 and the piston 10 so that the fluid is effectively compressed.

The first guiding means 200 contact the external wall of the cylindrical piston 10, defining a first guiding point 201. Similarly, the second guiding means 300 define a second guiding point 301 with the external wall of the cylindrical piston 10. FIG. 1 shows the guiding means 200, 300 arranged symmetrically with respect to the contact point 400 in a particular (but non-limiting) embodiment, though other embodiments of the present disclosure place the guiding means 200, 300 in different positions, which do not necessarily have to be symmetrical, as it will be further explained. In any case, the maximum allowable total separation of the guiding means 200, 300 is of 180°.

According to the first embodiment shown in FIG. 1, the first and second guiding means 200 and 300 are mounted on supporting orbitting means 500: when these supporting means 500 are entrained in rotation (by a motor, not shown) so they orbit around the cylindrical piston 10 and the body 40, the guiding means 200, 300 rotate around themselves (spin rotation), rolling and/or sliding over the external wall of the cylindrical piston 10, and orbiting at the same time around the piston 10 and the body 40. The supporting orbitting means 500 are mounted in such a way that the two guiding points contact on the walls of the cylindrical piston 10, to ensure a contact point 400, as previously explained. This is maintained during the complete rotation and functioning of the compressor. The orbitting of the supporting means 500 and the first and second guiding means 200, 300 is done around the axis of the shaft 20. In a whole turn, the cylindrical piston 10 is eccentrically entrained in rotation over the body 40 (in fact, over the axis of the shaft 20) by means of the guiding means 200, 300 so as to compress the fluid in the inner chamber.

FIGS. 2, 3, 4 and 5 show the different positionings of the supporting means 500 and the first and second guiding means 200, 300 in a complete turn over the body 40, at 0°, 90°, 180° and 270° positioning, respectively. Further similar cycles follow after these. As shown in these Figures, the positioning of the vane 30 is maintained fixed angularly with respect to the body 40, but slides within the slot 31 thanks to the tensioning device 32, ensuring that there is always a contact between the piston 30 and the inner walls of the cylindrical piston 10.

With the configuration as described for a compressor arrangement according to the present disclosure, it is possible to guarantee an excellent guidance of the movement of the cylindrical piston 10 over the body 40 during the whole compression cycle, minimising at the same time the efforts (less energy is dissipated compared to known systems) and also the possible vibrations in the arrangement.

Figure 6:
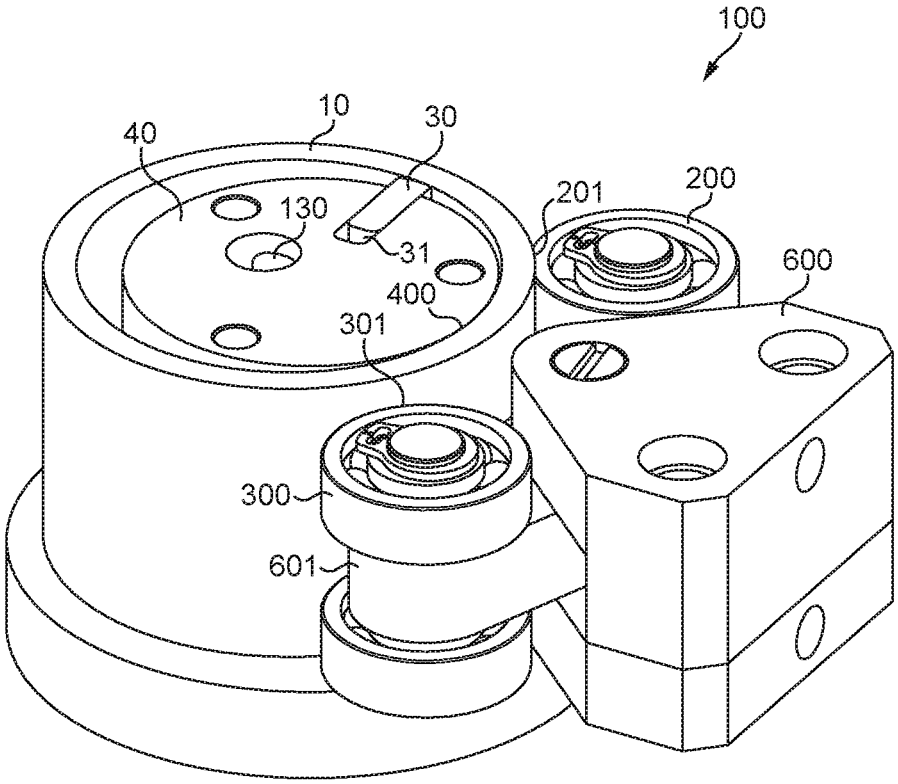
FIG. 6 shows an overview of the rotary compressor arrangement according to a second embodiment of the present disclosure.
Figure 7:
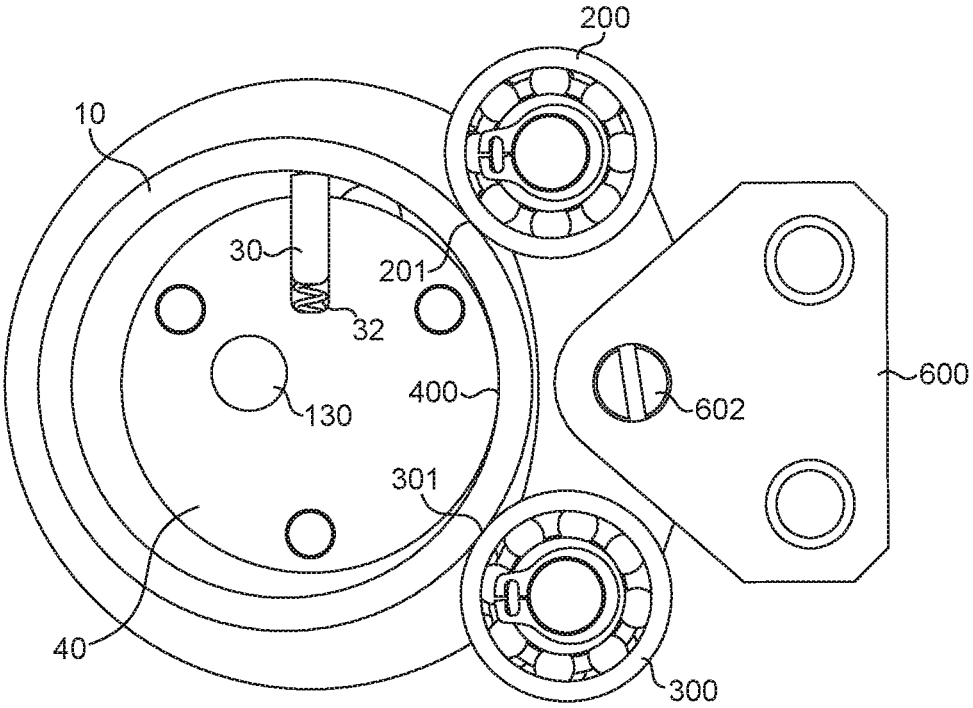
FIG. 7 shows an upper plan view of the rotary compressor arrangement of FIG. 6, where the contact point between the cylindrical piston and the body is arranged at an angular position of 270°.
Figure 8:
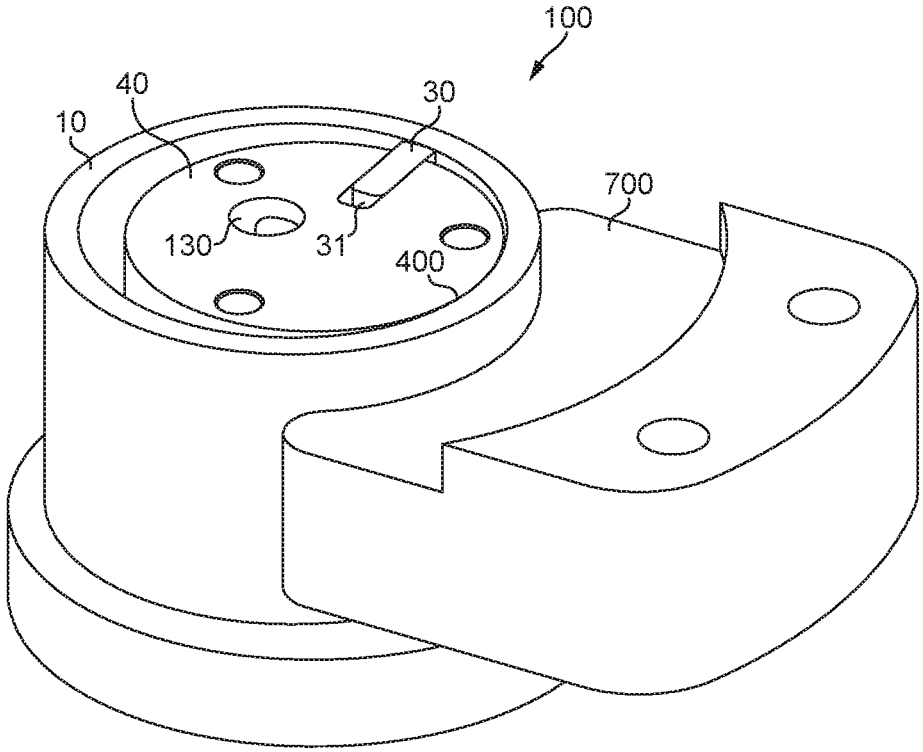
FIG. 8 shows an overview of the rotary compressor arrangement according to a third embodiment of the present disclosure.
Figure 9:
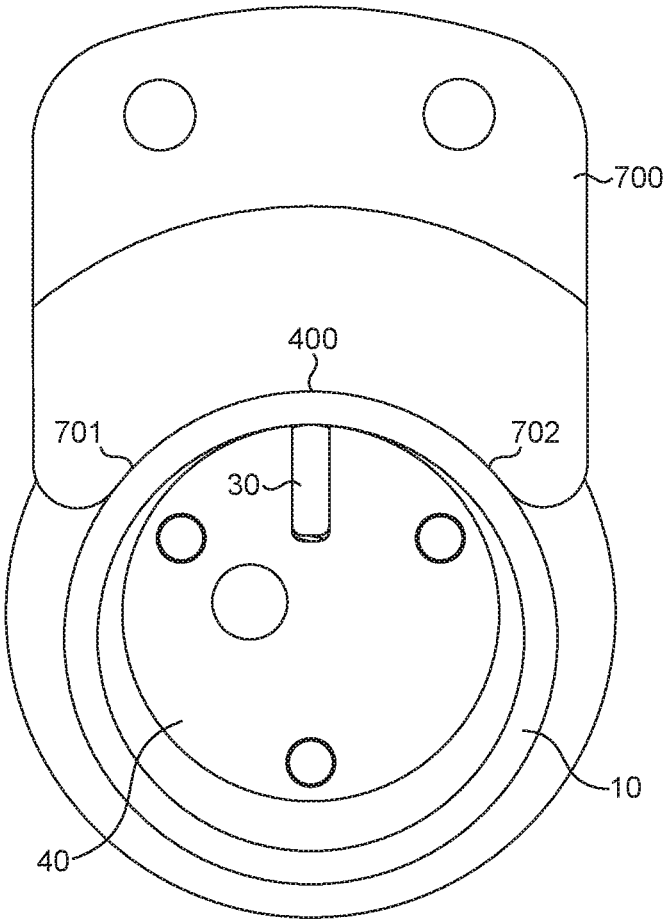
FIG. 9 shows an upper plan view of the rotary compressor arrangement of FIG. 8, where the contact point between the cylindrical piston and the body is arranged at an angular position of 0°.
Figure 10:
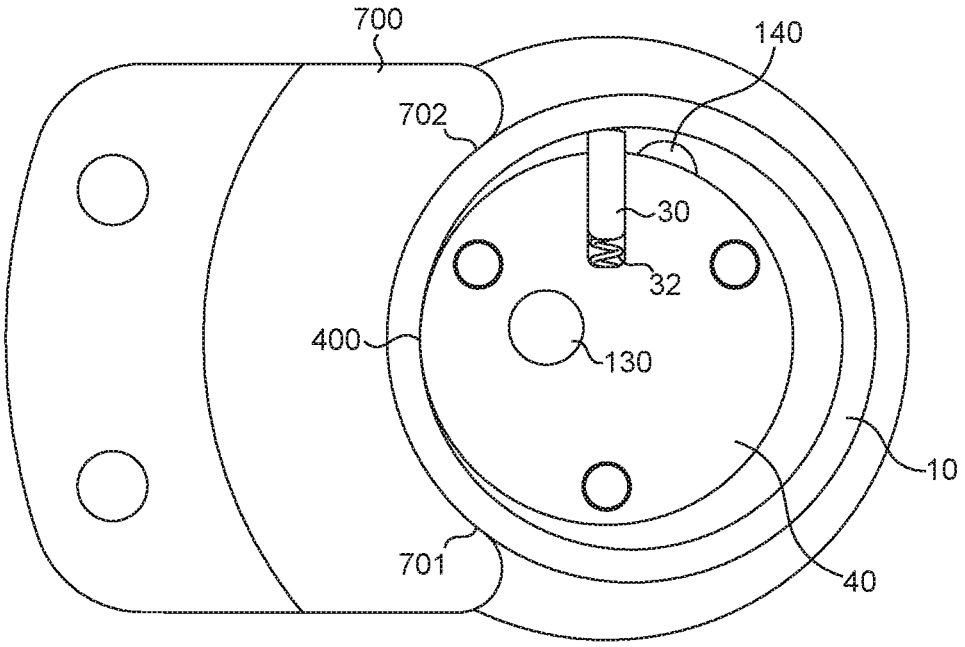
FIG. 10 shows an upper plan view of the rotary compressor arrangement of FIG. 8, where the contact point between the cylindrical piston and the body is arranged at an angular position of 90°.
Figure 11:
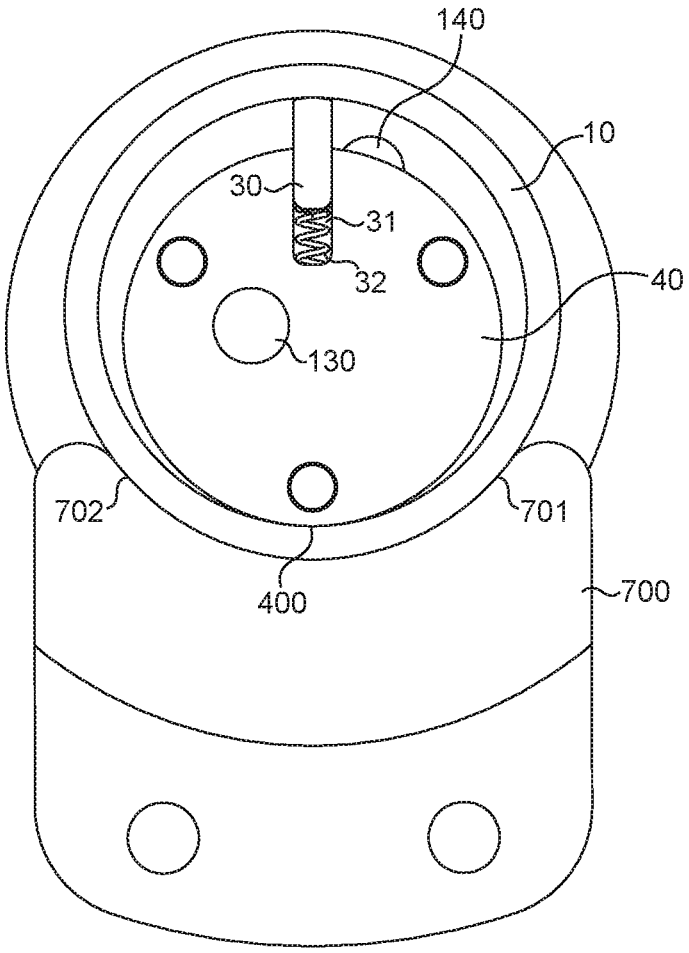
FIG. 11 shows an upper plan view of the rotary compressor arrangement of FIG. 8, where the contact point between the cylindrical piston and the body is arranged at an angular position of 180°.
Figure 12:
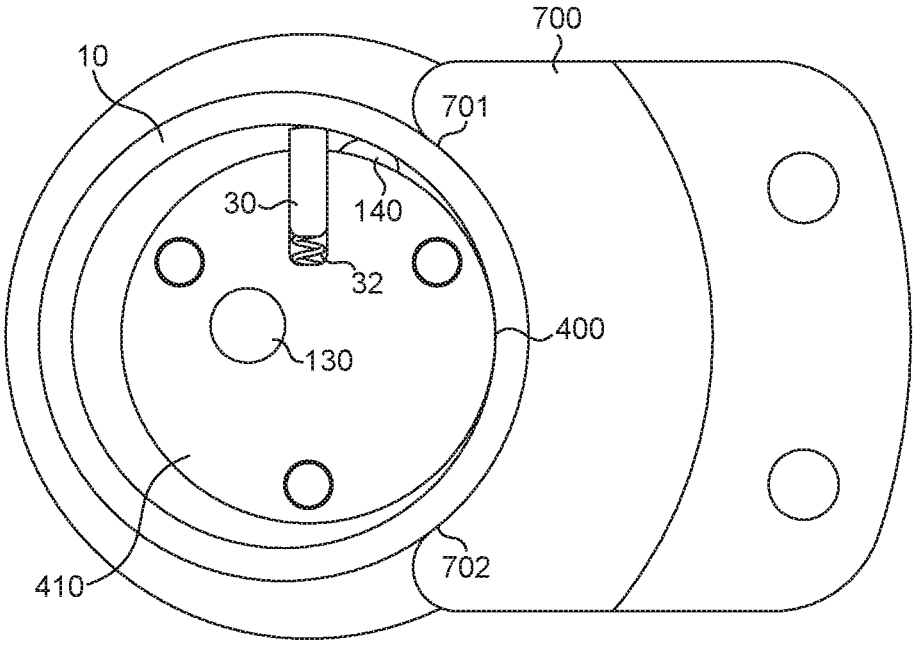
FIG. 12 shows an upper plan view of the rotary compressor arrangement of FIG. 8, where the contact point between the cylindrical piston and the body is arranged at an angular position of 270°.

According to a second embodiment of the present disclosure, as shown in FIG. 6 (FIG. 7 shows this positioning in an angle of 270°, similar to that shown in FIG. 5), the first and second guiding means 200, 300 are now mounted onto a pivotable support 600, which is able to pivot over a pivoting point 602. This embodiment is very similar to that already described but with a different repartition of the forces and allowing a higher degree of adaptation of the guiding means over the cylindrical piston 10. Typically, the guiding means 200, 300 are mounted onto the pivotable support 600.

Still, a third possible configuration of the present disclosure is shown in FIGS. 8-11, where the first and second guiding means have been replaced by a complete slider 700, covering the full angular arc in the external wall of the cylindrical piston 10 between a first and a second guiding points 201, 301. The slider 700 slides and pushes the cylindrical piston 10 over the body 40 in a similar way as that described for the first and second embodiments. The slider 700 can be made in steel or in a material having the appropriate tribologic properties (PTFE, polymer, graphite, etc.).

The main advantages of this solution with respect to the ones in the other two embodiments are the easiness of its manufacturing and the cost minimization.

Figure 16:
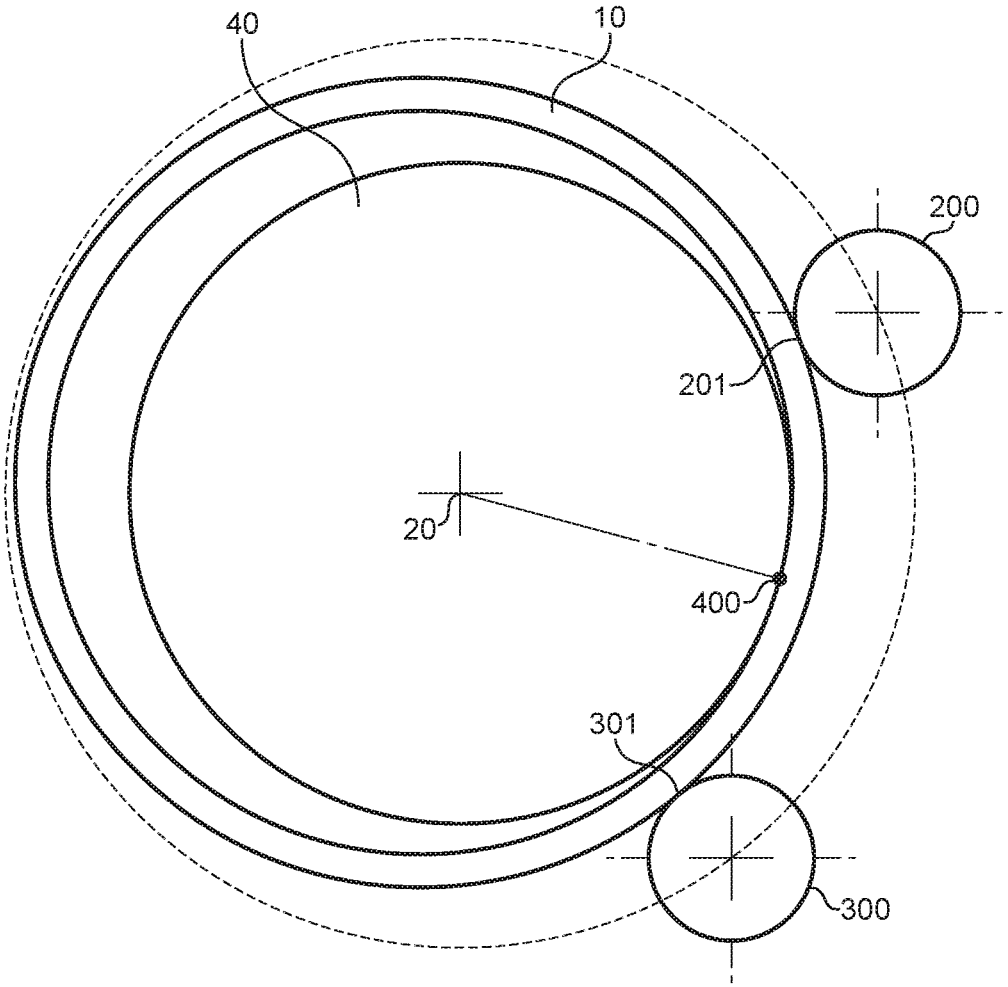
FIG. 16 shows a geometrical representation showing the positioning of the guiding means in a configuration similar to that of FIG. 15, the guiding means being arranged at both sides of the point of contact, in the same circumference, concentrically with respect to the central shaft.

FIG. 16 shows an exemplary geometrical distribution showing the first and second guiding means 200 and 300, arranged over the cylindrical piston 10, around the same concentrical circumference (or orbit), contacting in first and second guiding points 201 and 301, respectively, the external wall of the piston 10, and defining a contact point 400 arranged at equal angular distance of the guiding means 200 and 300.

Figure 17:
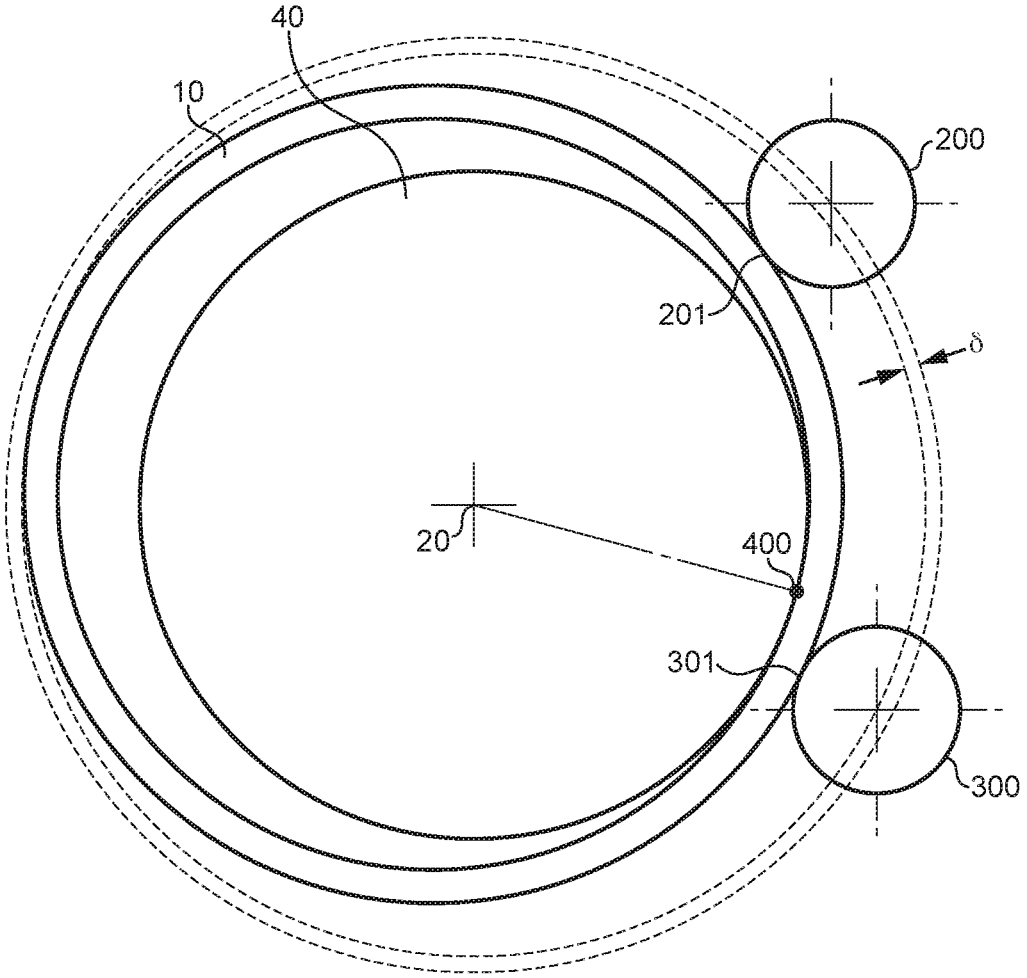
FIG. 17 shows a geometrical representation showing the positioning of the guiding means in a configuration similar to that of FIG. 15, the guiding means being arranged at both sides of the point of contact, in two different circumferences, both concentrically arranged with respect to the central shaft.

FIG. 17 shows another possible execution, similar to that explained for FIG. 16, but where the first and second guiding means 200, 300 are arranged at external circumferences which are offset a certain distance δ. The guiding means contact the external wall of the piston 10 in guiding points 201 and 301, but now the contact point 400 between the body and the piston is geometrically arranged at a location which is not angularly equidistant to the two guiding means. The higher δ is, the closer is the contact point 400 to the second guiding means 300, as represented in FIG. 17.

Figure 18:
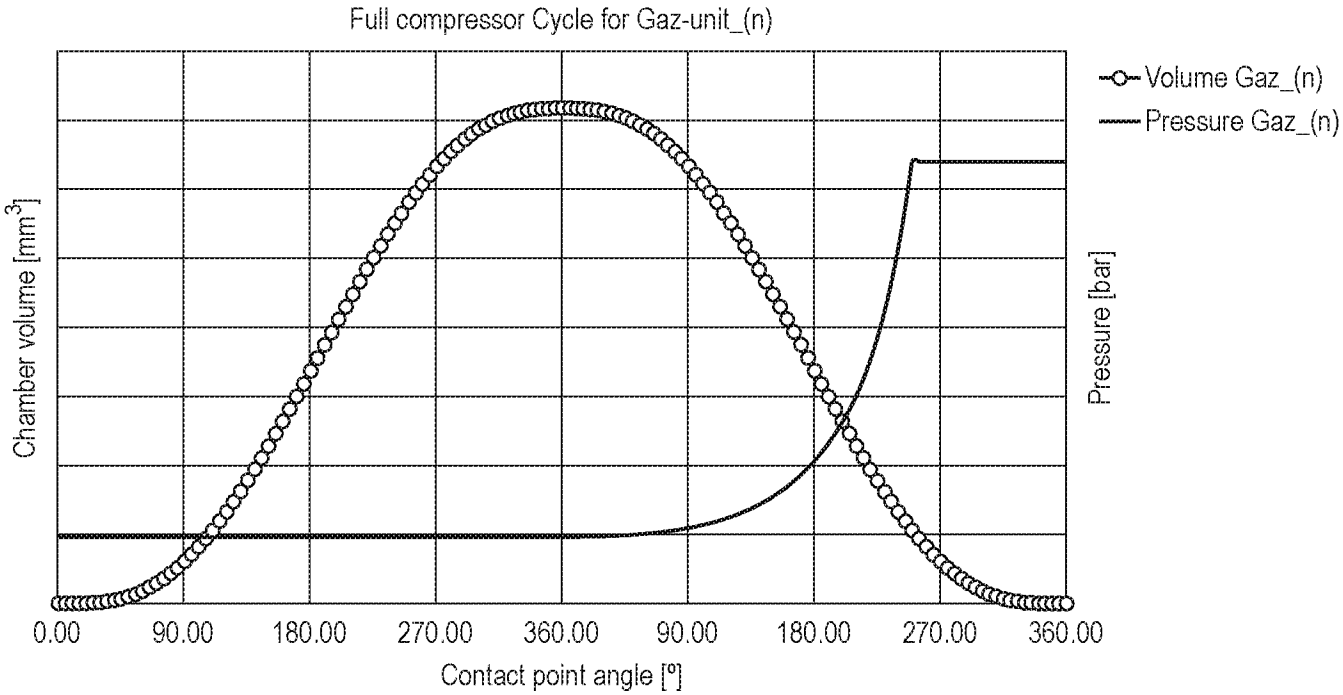
FIG. 18 shows a graph representing the volume occupied and the pressure of a refrigerant gas (n) in a compressor arrangement according to the present disclosure, following two complete cycles of 360° of the cylindrical piston over the body.

Turning now to the graphs, FIG. 18 shows, for a certain fluid n (typically a gas) into the chamber formed by the inner walls of the cylindrical piston 10 and the body 40, in two turns of 360° of the piston 10 over the body 40, the variation of the volume occupied by the fluid and the resulting pressure in the chamber. In the horizontal axis, it is represented the angle formed of the contact point 400 with respect to the point of contact of the vane 30 with the inner walls of the cylindrical piston 10.

Figure 2:
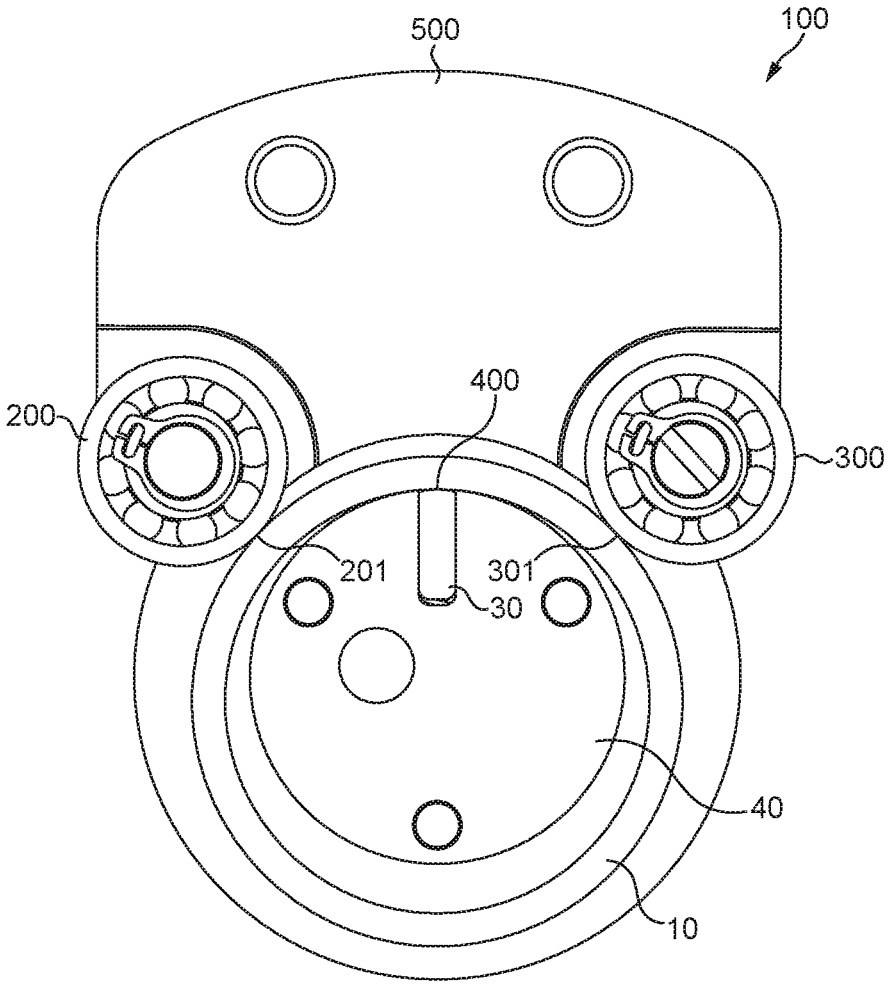
FIG. 2 shows an upper plan view of the rotary compressor arrangement of FIG. 1, where the contact point between the cylindrical piston and the body is arranged at an angular position of 0°.
Figure 3:
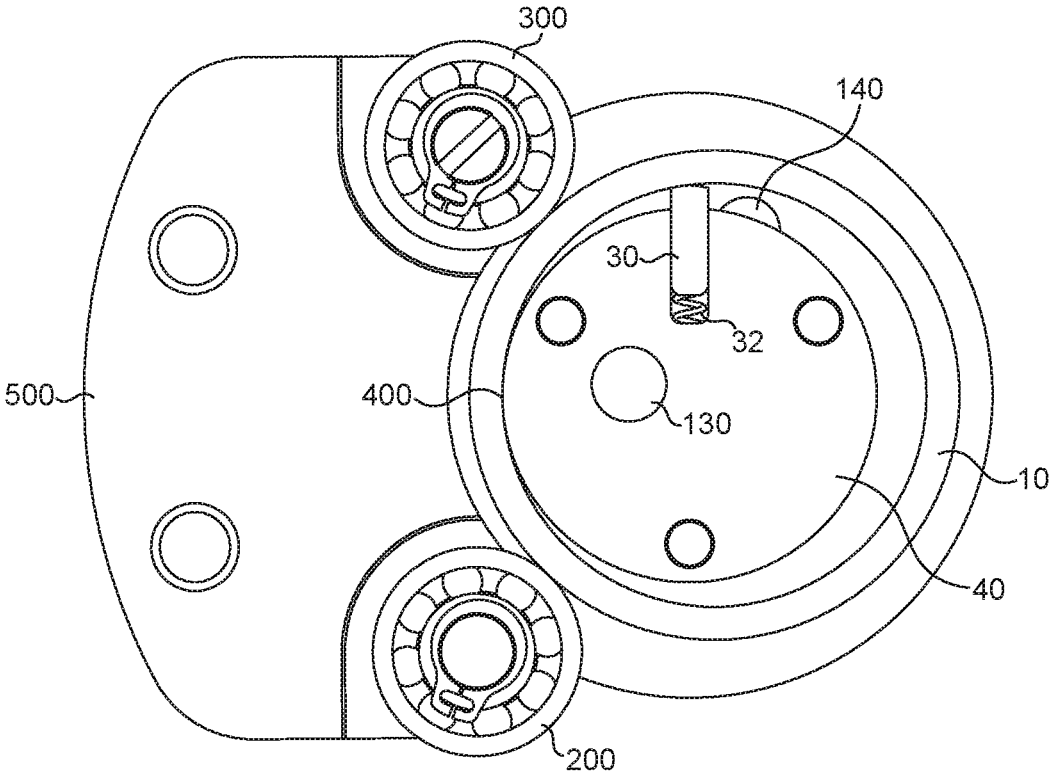
FIG. 3 shows an upper plan view of the rotary compressor arrangement of FIG. 1, where the contact point between the cylindrical piston and the body is arranged at an angular position of 90°.

For an angle 0°, taking for example FIG. 2, a certain gas n starts to be admitted by the inlet 130 in the chamber at a certain entry pressure, its volume increasing to a position of the contact point of 90° as represented in FIG. 3 (chamber space increasing between 0° and 90° in the volume formed between the vane 30, the inner walls of the piston 10 and the body 40, the smaller volume, on the left side of the Figure). This admission of fluid n continues at positions of the contact point of 180° (FIG. 4), 270° (FIG. 5) and 360° (back to FIG. 2), so its volume in the chamber continues increasing, while its pressure is maintained at the entrance pressure at which the fluid is provided through the inlet 130. This would represent a whole turn of the piston 10 over the body 40. Later, in a second turn, the gas n admitted starts to be compressed, so the volume it occupies in the inner chamber starts decreasing, so the gas starts increasing its pressure, until a certain outlet pressure value is reached: then, the outlet 140 opens to let the compressed gas exit. The Figures at 0°, 90°, 180° and 270° are similar as those in FIGS. 2, 3, 4 and 5, respectively, but looking now at the other volume chamber formed between the vane 30, the piston 10 and the body

40. The pressure values for the fluid n mainly depend on the nature of the fluid and on its temperature, therefore no specific values have been indicated in this graph.

Figure 4:
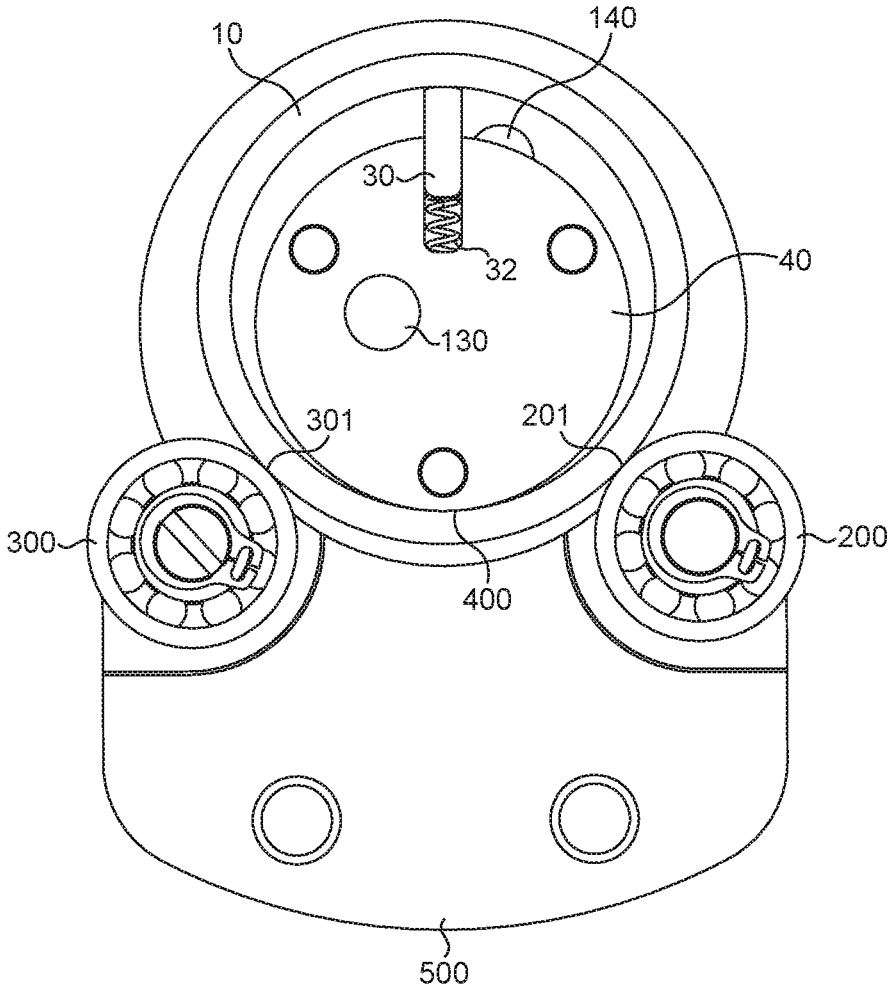
FIG. 4 shows an upper plan view of the rotary compressor arrangement of FIG. 1, where the contact point between the cylindrical piston and the body is arranged at an angular position of 180°.
Figure 5:
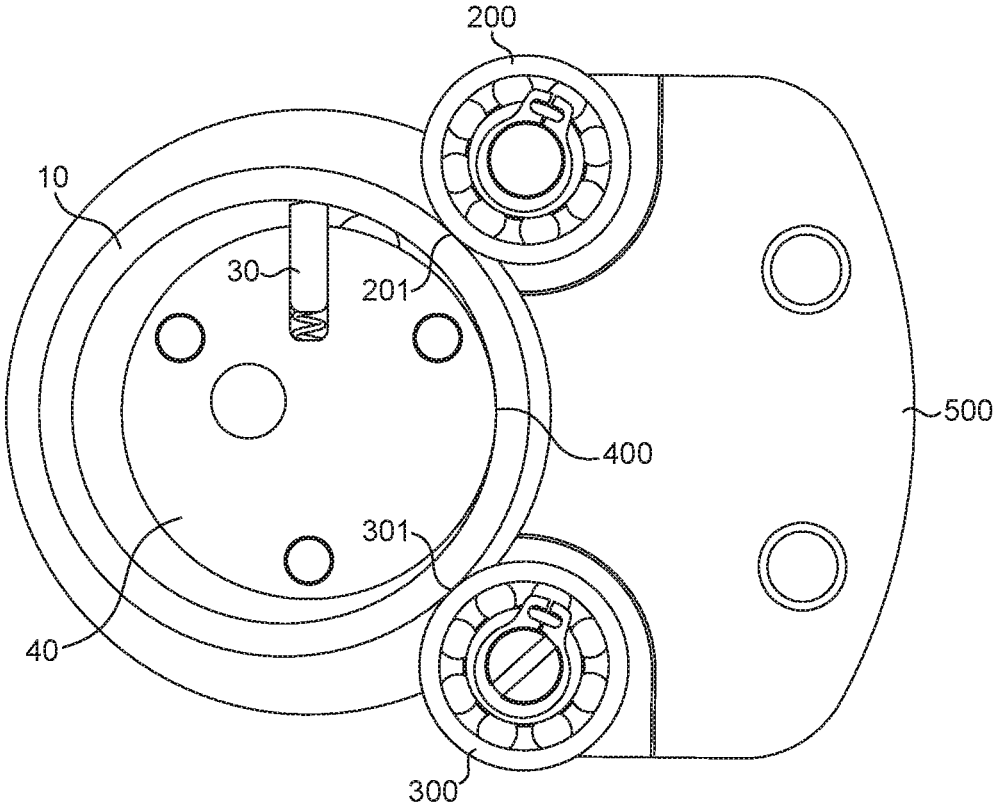
FIG. 5 shows an upper plan view of the rotary compressor arrangement of FIG. 1, where the contact point between the cylindrical piston and the body is arranged at an angular position of 270°.
Figure 19:
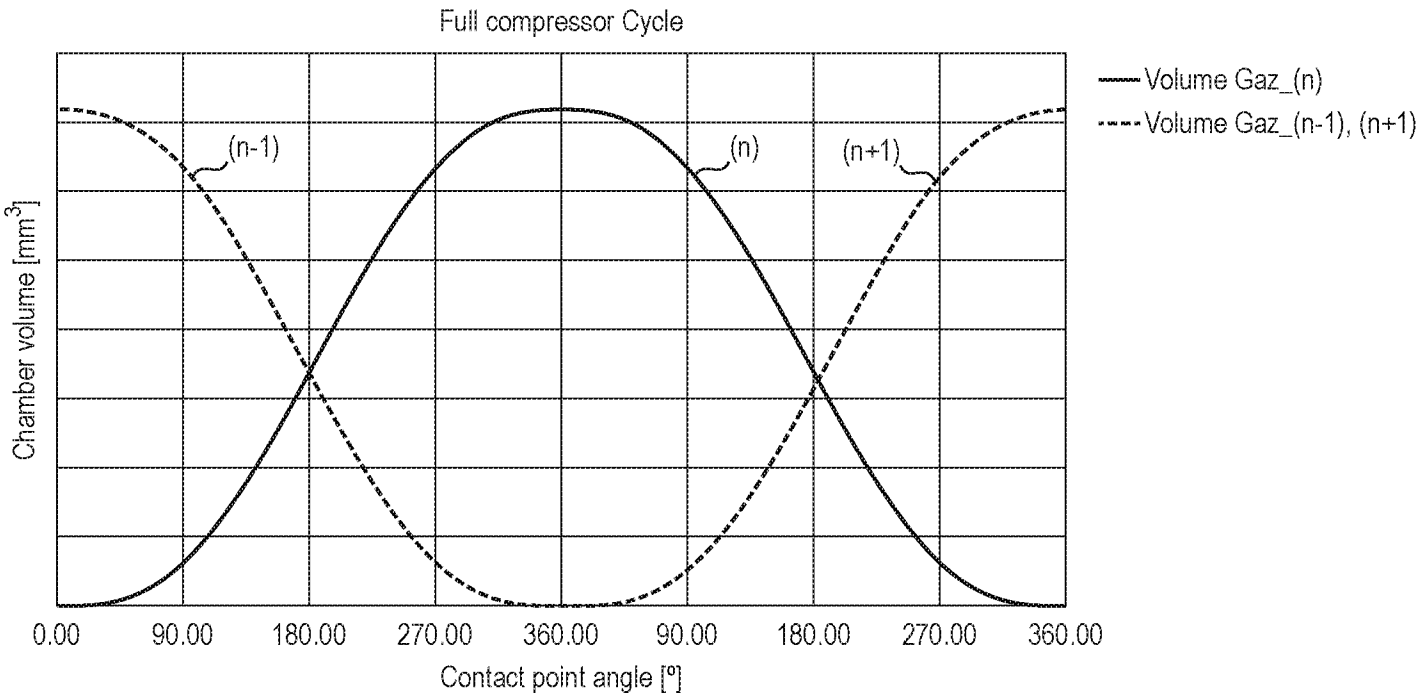
FIG. 19 shows a graph representing the comparison of the volumes occupied by refrigerant gases (n−1), (n) and (n+1) in a compressor arrangement according to the present disclosure, following two complete cycles of 360° of the cylindrical piston over the body.

FIG. 19 shows the variation of the volume in two cycles of 360° each but for a gas (n), for a gas (n−1) and for a gas (n+1). The curve showing the volume change followed by a gas (n) is represented in continuous in FIG. 19, and is similar to that in FIG. 18. The left side of the curve in dotted line is for a gas (n−1), superposed to that of gas (n): taking for example FIGS. 2, 3 and 4 for angles of 0°, 90° and 180° respectively, gas (n) would only start to be admitted in FIG. 2, while gas (n−1), coming from a previous cycle, would have already been admitted, therefore occupying the whole inner chamber volume, its volume being maximum. In the position of 90° represented in FIG. 3, gas (n) would start admission and increasing its volume (small chamber volume at the left side of the vane 30), while gas (n−1) would start being decreased in volume (the volume of the chamber it occupies, i.e. that at the right side of the vane 30, has decreased from the one at 0°). Continuing with the explained tendency, gas (n) would continue increasing its volume while gas (n−1) would continue decreasing it, until a positioning as the one shown in FIG. 4, at 180°, where the volume occupied by both gases would be the same (two similar chamber volumes as shown in FIG. 4, at the left and right sides of the vane 30). The cycle would continue in FIG. 5 (270°) up to 360° (similar again to FIG. 2), where gas (n−1) continues to be compressed, continues decreasing its volume, while gas (n) keeps being admitted by the entry 130 and therefore occupying higher volume.

The right side of the curves in FIG. 19 show the volume variation for the gas (n) and for a gas (n+1): while the volume of gas (n), once fully admitted in the chamber and occupying the maximal volume at point 360°, starts decreasing, so it is compressed and therefore provided through the exit 140, gas (n+1) follows a similar curve on its volume as that followed by gas (n) previously, that is, it is admitted from a start position until it occupies the full inner volume of the chamber, similar to what happened in the previous cycle to gas (n). It is to be understood that these curves would continue periodically at cycles of 360° for gas (n+1) replacing gas (n−1), gas (n+2) replacing gas (n), and gas (n+3) replacing gas (n+1), and so on.

Figure 20:
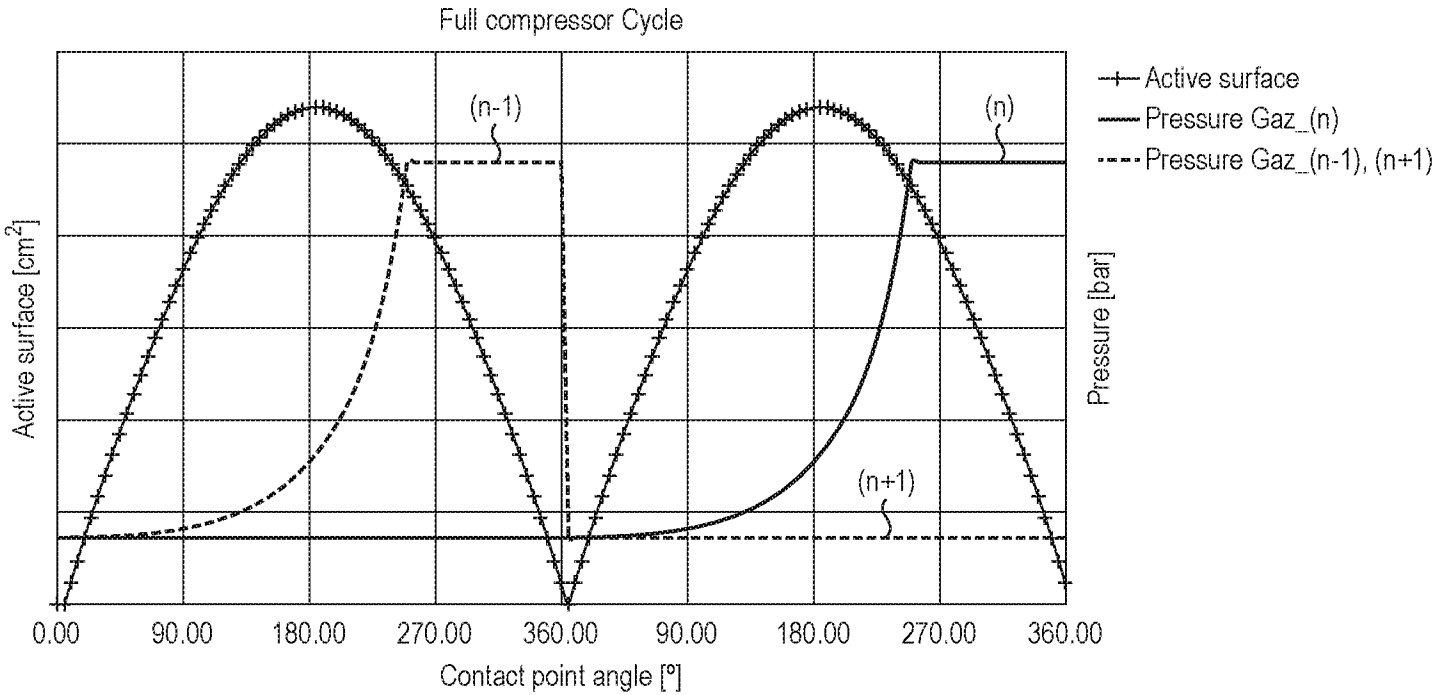
FIG. 20 shows a graph representing the pressure of refrigerant gases (n−1), (n) and (n+1) and the active surface in a compressor arrangement according to the present disclosure, following two complete cycles of 360° of the cylindrical piston over the body.

Following the above explanation, FIG. 20 shows now the active surface values in two cycles of 360°. By active surface it should be understood the segment length value formed by the contact point 400 and the point where the vane 30 contacts the inner wall of the cylindrical piston 10, multiplied by the height (or depth) of this segment, thus obtaining a surface value. The active surface starts being zero at the 0° position (FIG. 2) where the contact point 400 corresponds to the point of contact of the vane 30 and the piston 10 internally. The active surface increases up to the position of 180° (FIG. 4), where its value is maximum, and from this maximum value it starts decreasing, to its zero value back in FIG. 2.

Once the active surface is calculated, the graph in FIG. 20 further shows the gas pressure, for a gas (n−1), for a gas (n) and for a gas (n+1): that for gas (n) is the same as the one shown in FIG. 18, while that for gas (n−1) and (n+1) are the same, but shifted 360°.

Figure 21:
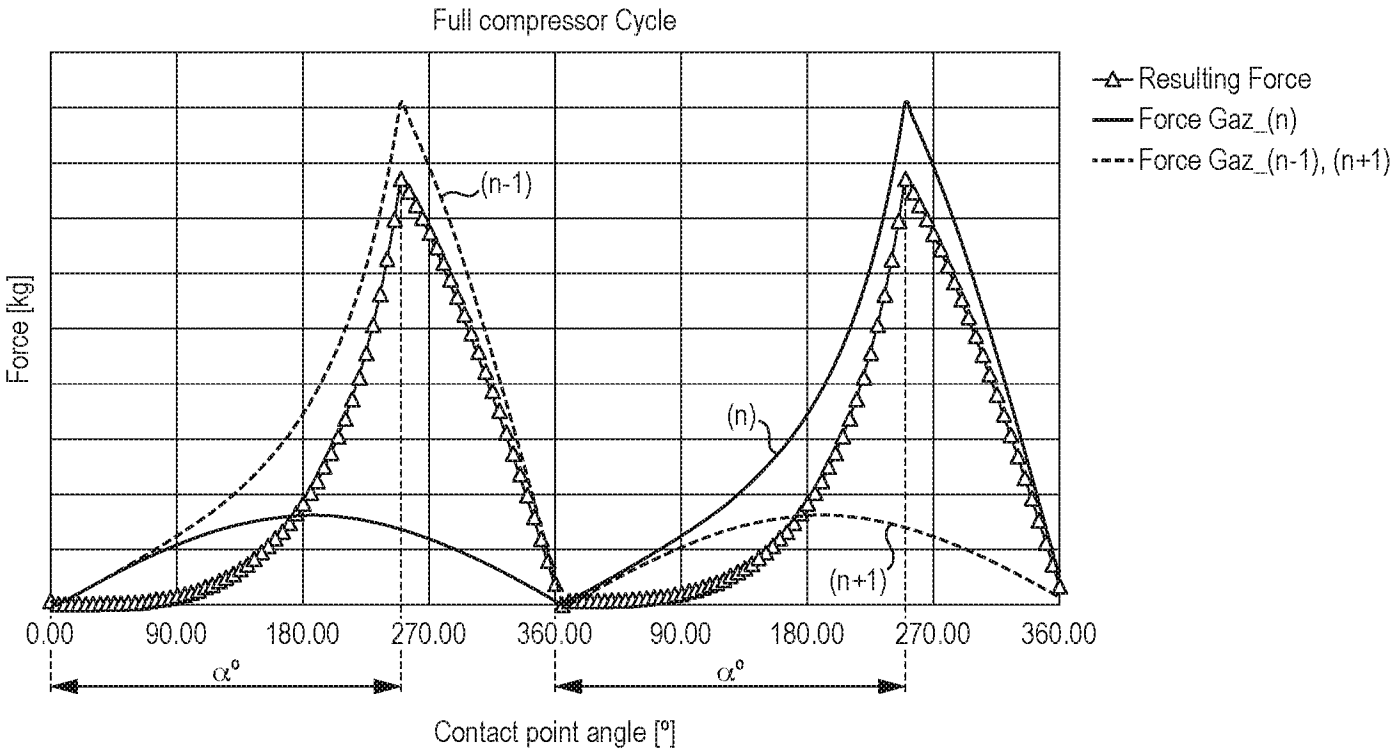
FIG. 21 shows a graph representing the force exerted by refrigerant gases (n−1), (n) and (n+1) calculated taking into account the active surface, and the total resulting force of them, in a compressor arrangement according to the present disclosure, following two complete cycles of 360° of the cylindrical piston over the body.

Departing from the values in the graph of FIG. 20, the resulting force of a gas inside the chamber towards the inner walls of the cylindrical piston 10 and towards the body 40 are shown in FIG. 21. The force of a certain gas is now calculated as the active surface (marked as 901 in FIG. 22, between the contact point 400 and the point where the vane 30 contacts the inner walls of the cylindrical piston 10, understanding the value of this length by the height) multiplied by the pressure of the gas. In a first cycle of 360°, the resulting forces come the sum (sum of vectorial forces, hence calculated as subtraction of the values in the graph of FIG. 20 as they are in opposite direction) of a previous admitted gas (n−1) and from the newly admitted one (n), the sum of both being marked in the graph as resulting force. The maximum force exerted by the gases towards the piston 10 and the body occurs at a contact point 400 situated at an angle α° (exemplified close to 270° in the example given by the Figure). The same curves occur for a second cycle of 360° shown on the right side of FIG. 21, but now for the gas (n), completely admitted and now being compressed in this cycle, and for gas (n+1) which is the newly admitted gas into the chamber. The resulting force is calculated in the same way, as the sum of the forces exerted by both gases. The resulting force is the same as the one in the previous cycle, considering the same gas (nature, quantity and temperature) admitted.

Under these circumstances, the same positioning at angle α° for the contact point 400 is the one giving the maximum force exerted by the gases inside the chamber.

Figure 15:
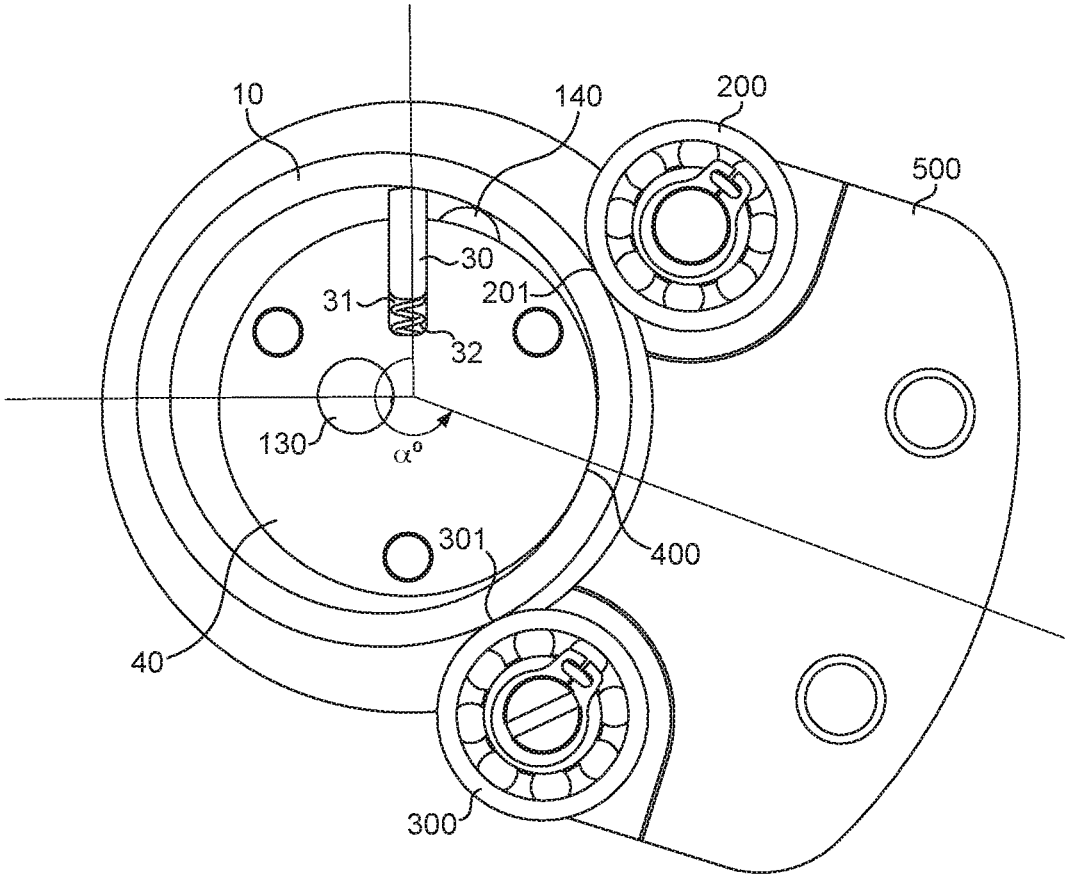
FIG. 15 shows an upper plan view of the rotary compressor arrangement of FIG. 1, where the contact point between the cylindrical piston and the body is arranged at an angular position where the resulting force from the fluid in the chamber is maximal.
Figure 22:
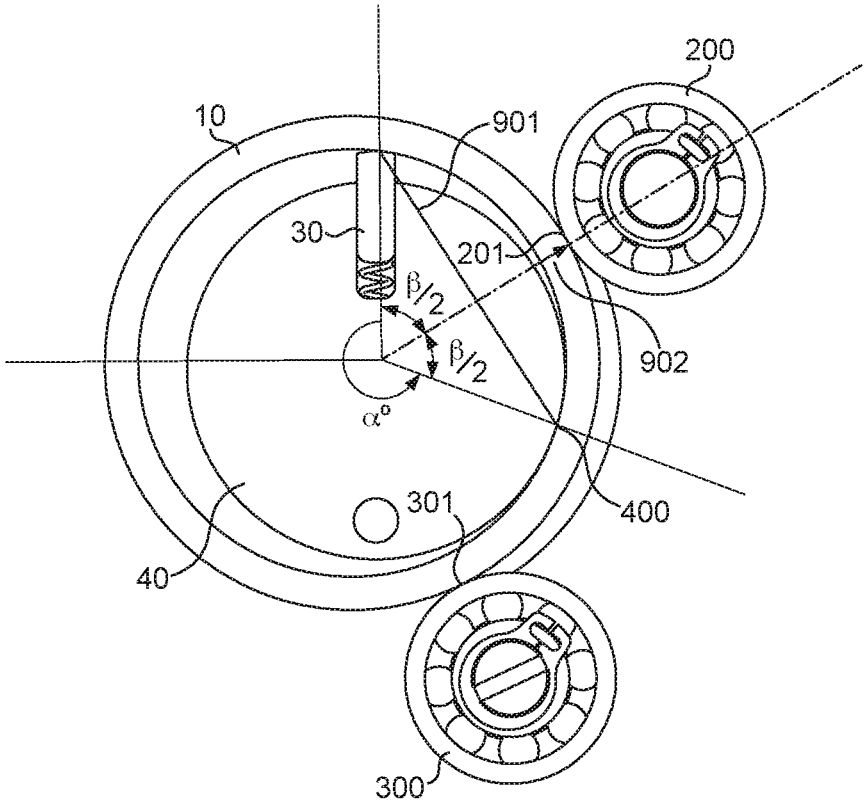
FIG. 22 shows a schematic view representing the configuration where the force exerted by the fluid in the inner chamber is maximum, in a rotary compressor arrangement according to a first embodiment of the present disclosure.

FIG. 15 shows the positioning of the contact point 400 at an angle of α° where the resulting force exerted by the gases is maximal. Typically, for calculating the positioning of the first and second guiding means 200, 300 or at least for the guiding points 201 and 301 (for other embodiments), first the angle α° where the force exerted is maximal is established, as per the graph in FIG. 21. Looking at FIG. 22, the positioning of the contact point 400 at an angle α° is then arranged. From this configuration, the force vector 902 is derived in the bisectrix of an angle formed by the contact point 400 and the contact of the vane 30 with the walls of the cylindrical piston 10, forming an angle (β/2)° with respect to the vane 30 and the same angle (β/2)° with respect to the contact point 400. Thus, the first guiding point position (201 in FIG. 22) is defined such as to apply a counter-force at this point. The second guiding point 15 (301 in FIG. 22) is then placed on the other side of the contact point 400 for guidance and equilibrium purposes. As shown in FIG. 22, the angle β° is equal to 360° minus α°.

The location of the maximum force is widely related to the gas type, to the compressor operating conditions and to fluid conditions such as gas pressure and temperature at the entrance, and can change over time during functioning; therefore, the location of the maximum force can also change during the functioning of the compressor.

For this reason, the position of the guiding points 201 and 301 is generally defined just at a given angle below 180° form both sides of the contact point 400 to avoid any leverage effect around the contact point 400 by the force induced by the pressure generated in the inner chamber during compression.

The guiding points 201, 301 can be symmetric (equally distance) with respect to the point of contact 400 or not.

Although the present disclosure has been described with reference to particular embodiments thereof, many modifications and alternations may be made by a person having ordinary skill in the art without departing from the scope of the present disclosure which is defined by the appended claims.

The invention claimed is:

1. A cooling/refrigerating system comprising:

a rotary compressor arrangement comprising:

a body centered at a shaft axis;

a cylindrical piston eccentrically arranged with respect to the body such that an inner volume is created between them, into which volume a compressible fluid can be introduced, and guiding means arranged at an offset axis with respect to the shaft axis, the guiding means orbiting around the shaft axis, entraining and guiding in rotation the cylindrical piston over the body, wherein the guiding means provide at least two guiding points when contacting an external surface of the cylindrical piston, the guiding points being positioned in such a way with respect to the cylindrical piston that a contact point between the body and the cylindrical piston, within the inner volume, is ensured during the rotation of the cylindrical piston.

2. A rotary compressor arrangement comprising:

a body centered at a shaft axis;

a cylindrical piston eccentrically arranged with respect to the body such that an inner volume is created between them, into which volume a compressible fluid can be introduced;

guiding means arranged at an offset axis with respect to the shaft axis, the guiding means orbiting around the shaft axis, entraining and guiding in rotation the cylindrical piston over the body, wherein the guiding means provide at least two guiding points when contacting an external surface of the cylindrical piston, the guiding points being positioned in such a way with respect to the cylindrical piston that a contact point between the body and the cylindrical piston, within the inner volume, is ensured during the rotation of the cylindrical piston; and a motor driving the guiding means to orbit around the shaft axis.

3. A rotary compressor arrangement comprising:

a body centered at a shaft axis;

a cylindrical piston eccentrically arranged with respect to the body such that an inner volume is created between them, into which volume a compressible fluid can be introduced; and guiding means arranged at an offset axis with respect to the shaft axis, the guiding means orbiting around the shaft axis, entraining and guiding in rotation the cylindrical piston over the body, wherein the guiding means provide at least two guiding points when contacting an external surface of the cylindrical piston, the guiding points being positioned in such a way with respect to the cylindrical piston that a contact point between the body and the cylindrical piston, within the inner volume, is ensured during the rotation of the cylindrical piston;

wherein the compressible fluid comprises a refrigerant gas.

4. A rotary compressor arrangement comprising:

a body centered at a shaft axis;

a cylindrical piston eccentrically arranged with respect to the body such that an inner volume is created between them, into which volume a compressible fluid can be introduced; and guiding means arranged at an offset axis with respect to the shaft axis, the guiding means orbiting around the shaft axis, entraining and guiding in rotation the cylindrical piston over the body, wherein the guiding means provide at least two guiding points when contacting an external surface of the cylindrical piston, the guiding points being positioned in such a way with respect to the cylindrical piston that a contact point between the body and the cylindrical piston, within the inner volume, is ensured during the rotation of the cylindrical piston;

wherein lubricating oil is also provided together with the compressible fluid, the lubricating oil being compatible with the compressible fluid.

5. A rotary compressor arrangement comprising:

a body centered at a shaft axis;

a cylindrical piston eccentrically arranged with respect to the body such that an inner volume is created between them, into which volume a compressible fluid can be introduced; and guiding means arranged at an offset axis with respect to the shaft axis, the guiding means orbiting around the shaft axis, entraining and guiding in rotation the cylindrical piston over the body, wherein the guiding means provide at least two guiding points when contacting an external surface of the cylindrical piston, the guiding points being positioned in such a way with respect to the cylindrical piston that a contact point between the body and the cylindrical piston, within the inner volume, is ensured during the rotation of the cylindrical piston;

wherein the guiding means comprise two satellite guiding means, each one contacting the cylindrical piston in a guiding point of the at least two guiding points, the guiding means rolling and/or sliding over the cylindrical piston while orbiting around the shaft axis.

6. The rotary compressor arrangement according to claim 5, wherein the guiding means are arranged such that the guiding points created are angularly located on each side of the contact point, at least one of the guiding points being located on a side of the resulting force generated by the compressible fluid in the inner volume on the cylindrical piston.

7. The rotary compressor arrangement according to claim 6, wherein at least one of the guiding points is located close to the point of the maximum resulting force generated by the compressible fluid in the inner volume on the cylindrical piston.

8. The rotary compressor arrangement according to claim 5, wherein the guiding means are arranged at a maximum angle of 180°.

9. The rotary compressor arrangement according to claim 5, wherein the guiding points are arranged on a same radius, with respect to the shaft axis, at substantially equal angles with respect to the contact point.

10. The rotary compressor arrangement according to claim 5, wherein the guiding points are arranged on two different radiuses, with respect to the shaft axis.

11. The rotary compressor arrangement according to claim 5, wherein the guiding means are mounted on supporting orbiting means rotating around the shaft axis.

12. The rotary compressor arrangement according to claim 5, wherein the guiding means are mounted onto a pivotable support, rotating around the shaft axis and which is further able to pivot over a pivoting point.

13. The rotary compressor arrangement according to claim 5, further comprising at least one vane slidable within the body during rotation of the cylindrical piston in such a way that it contacts the inner wall of the cylindrical piston.

14. The rotary compressor arrangement according to claim 13, further comprising a tensioning device exerting pressure over the at least one vane so that it contacts the inner wall of the cylindrical piston as it rotates around the body.

15. The rotary compressor arrangement according to claim 13, wherein the at least one vane creates at least one compression chamber whose volume is decreased by rotation of the cylindrical piston so that the compressible fluid is compressed before being discharged.

16. The rotary compressor arrangement according to claim 5, comprising an entry for the compressible fluid being admitted into the inner volume and an outlet for the compressed compressible fluid exiting the inner volume, the inlet and the outlet being each arranged on one side of a vane.

17. The rotary compressor arrangement according to claim 5, further comprising an upper plate and a lower plate arranged to close in height in a tight manner at least one compression chamber created between the body and the cylindrical piston.

18. The rotary compressor arrangement according to claim 17, further comprising at least one segment element arranged between the upper and/or lower plates to allow a tight sealing of at least one compression chamber and the movement of the cylindrical piston.

19. The rotary compressor arrangement according to claim 18, wherein the at least one segment element comprises a low friction material.

* * * * *